US006773258B1

(12) United States Patent
Wong

(10) Patent No.: US 6,773,258 B1
(45) Date of Patent: Aug. 10, 2004

(54) WINDPROOF LIGHTER

(76) Inventor: Chi Lam Wong, 1617 S. Euclid Ave., San Gabriel, CA (US) 91776

( * ) Notice: Subject to any disclaimer, the term of this patent is extended or adjusted under 35 U.S.C. 154(b) by 0 days.

(21) Appl. No.: 10/632,441

(22) Filed: Aug. 2, 2003

(51) Int. Cl.[7] ..... F23Q 2/00
(52) U.S. Cl. ..... 431/142; 431/255; 431/277
(58) Field of Search ..... 431/142, 255, 431/277, 143, 251, 151

(56) References Cited

U.S. PATENT DOCUMENTS 4,097,222 A * 6/1978 Faudemay ..... 431/344
4,181,493 A * 1/1980 Piffath et al. ..... 431/344
4,906,179 A * 3/1990 Nitta ..... 431/264
5,310,336 A * 5/1994 Segawa ..... 431/131
5,743,724 A * 4/1998 Mifune et al. ..... 431/126
5,915,953 A * 6/1999 Mifune et al. ..... 431/268
6,267,582 B1 * 7/2001 Lin ..... 431/153
6,402,506 B1 * 6/2002 Lin ..... 431/153

* cited by examiner

*Primary Examiner*—Alfred Basichas

(57) ABSTRACT

A windproof lighter comprising: a lighter housing, a gas container for storing liquid inflammable gas, a storage with an inlet valve and an outlet valve, an outlet lever for control of gas supply from storage, a windproof jet means connected to a gas passage of said storage and an igniter assembly, characterized by further comprising a supporting seat on said lighter housing for connecting windproof jet means, a bracket dismountably provided in or above said lighter housing and said supporting seat, wherein said bracket has one side sleeved onto said supporting seat or connected to said windproof jet means while the other side provided with an igniter assembly, and when said bracket is dismounted, said windproof jet means partially protrudes over said supporting seat, so that said windproof jet means may be dismountably mounted with said supporting seat. With such a simple structure the lighter may be used for longer time and generate better flames.

8 Claims, 6 Drawing Sheets

WINDPROOF LIGHTER

FIELD OF THE INVENTION

The present invention relates to an ignition device, and in particular, to a lighter using inflammable gas stored in liquidity as fuel to produce wind-proof torch flames.

BACKGROUND OF THE INVENTION

Currently, windproof lighters on market include candlelight-flame lighters and wind-proof lighters. Among them the former produce visual candlelight flames and the latter, windproof lighters, produce strong and blue-colored torch flames with high temperature and are used wider than the former as they have quicker ignition. Just because of this advantage, such a lighter has more complicated structure than the candlelight-flame lighters. Most of such windproof lighters may produce strong and high-temperature flames by providing a pore passage within the windproof gas jet means of the windproof lighter. According to the technical solutions disclosed by the applicant's previous applications for patents, the gas from a storage may turn to a forceful quick flow when passing through said pore passage, form a strong mixed gas after mixing with the air within the mixing chamber of said windproof gas jet means, and then, be injected as strong mixed fuel gas flow from a diverting nozzle to generate strong torch flame with high temperature after ignition.

During the process of continuous perfection of the invention, the applicant has discovered that as the diameter of the pore passage is too small, the gas injected from said storage inevitably contains something unwanted which may easily block the pore passage. Even if a fine mess is provided in front of said pore passage, long time use or careless operation may still lead to the block. In addition, the windproof jet means is installed within the lighter, user may not be able to clear up or replace it. Consequently once the pore passage is blocked, the whole lighter would be discarded.

SUMMARY OF THE INVENTION

One objective of the present invention is to provide a windproof lighter with a dismountable windproof jet means.

A further objective of the present invention is to provide a windproof lighter which may not only have dismountable windproof jet means, but also assure generation of forceful quick flow of fuel gas injected from said windproof jet means.

Another objective of the present invention is to provide a windproof lighter with a replaceable igniter assembly. According to the present invention, if the pore passage of the windproof jet means is blocked, the lighter may be restored to normal use by simply replacing said windproof jet means, and the lighter may therefore be used for much longer time. Meanwhile, as the igniter assembly and a bracket are of an independent structure, even if there is ignition failure, igniter assembly may be replaced easily. Further the simplified structure according to the present invention may assure better flame results.

The objectives of the present invention is achieved in such a way that the windproof lighter includes: a lighter housing, a gas container for storing liquid inflammable gas, a storage with an inlet valve and an outlet valve, an outlet lever for control of gas supply from storage, a windproof jet means connected to a gas passage of said storage and an igniter assembly, characterized by further comprising a supporting seat on said lighter housing for connecting windproof jet means, a bracket dismountably provided in or above said lighter housing and said supporting seat, wherein said bracket has one side sleeved onto said supporting seat or connected to said windproof jet means while the other side provided with an igniter assembly. When said bracket is dismounted, said windproof jet means partially protrudes over said supporting seat, so that said windproof jet means may be dismountably mounted with said supporting seat.

Further, said supporting seat has its lower end connected to said outlet valve and said windproof jet means is connected to said supporting seat, wherein the inlet port of said windproof jet means is located at the tail portion of lower end of said supporting seat, and the port of said outlet valve is connected to said windproof jet means. Said windproof jet means is connected to said supporting means by virtue of screw.

Furthermore, a sealing ring is provided between said lower end of said supporting seat and the lower end of said windproof jet means.

The port of said outlet valve is connected to a soft pipe which has another end sleeved and connected to the inlet port of said supporting seat.

Said outlet valve has a sealing ring provided on its valve core which extends into said inlet port of the lower end of said supporting seat and is sealed therewith.

Additionally, said igniter assembly includes an electronic igniter and a sleeve or a wheel, flint and a spring means.

BRIEF DESCRIPTION OF THE DRAWINGS

Further description to the present invention will be made by reference to the following drawings and embodiments, wherein.

Wherein: 1—lighter housing; 2—storage; 21—gas container; 22—inlet valve; 23—outlet valve; 231—outlet core; 232—diverting passage; 24—sealing ring of outlet valve core; 25—soft pipe; 3—outlet control lever; 4—windproof jet means; 41—inlet port of windproof jet means; 42—sealing ring of inlet port; 43—outlet pipe of candlelight flame; 5—supporting seat; 51—inlet port of supporting seat; 6—igniter assembly; 61—electronic igniter; 62—sleeve; 63—flint igniter; 631'—wheel; 632'—flint; 633'—spring; 7—bracket; 71—port of windproof gas flow; 72—port of candlelight gas flow; 8—switch.

DETAILED DESCRIPTION OF THE INVENTION

Figure 1:
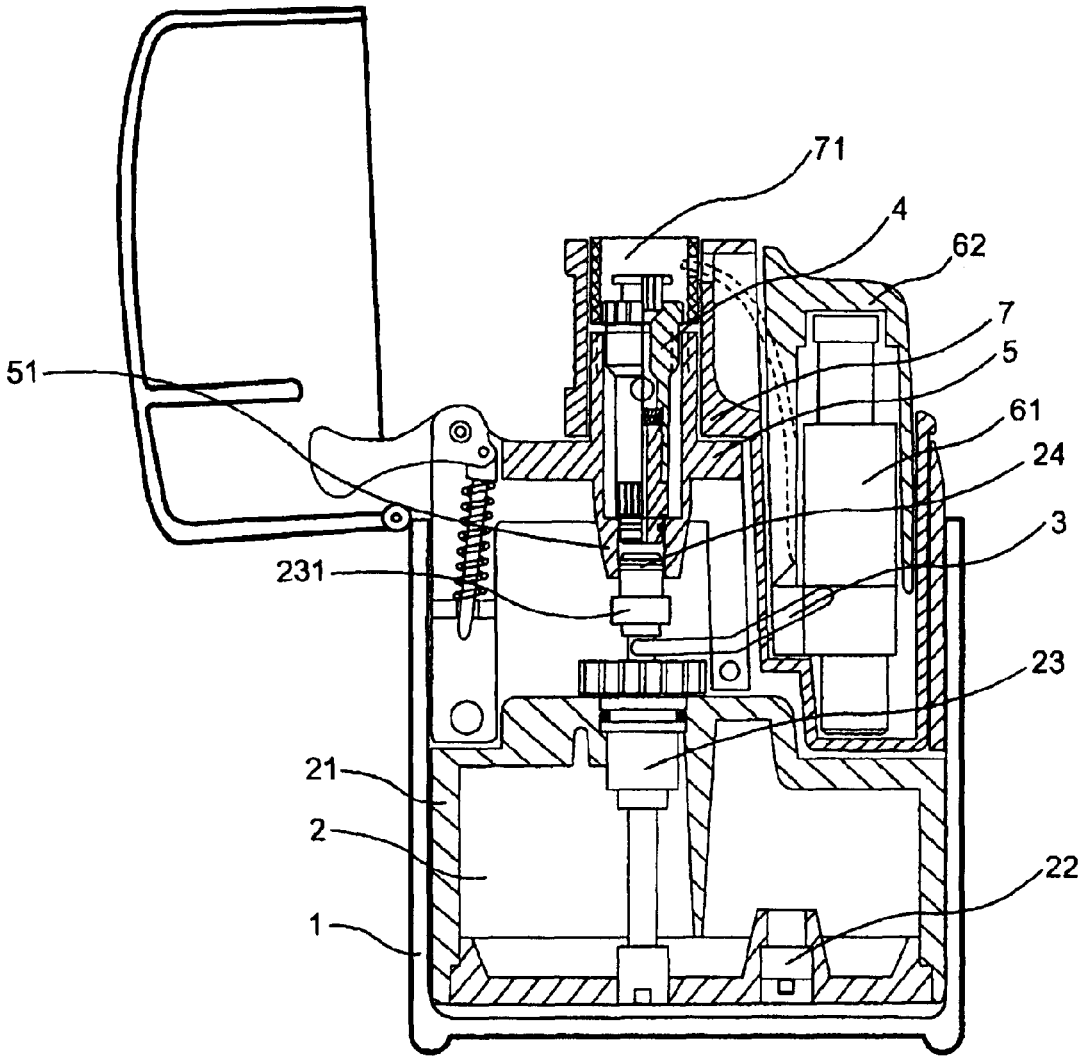
FIG. 1 is a structural sketch of the first embodiment of the present invention.

Refer to FIG. 1. The windproof lighter according to the present invention comprises a lighter housing 1, a gas container 21 for containing liquid inflammable fuel gas, a storage 2 with an outlet valve 23 and an inlet valve 22, a lever 3 for control of gas supply from said storage 2, a windproof jet means 4 connected to the gas passage of said storage 2, an igniter assembly 6 fixed within said lighter housing 1, which according to the embodiment hereunder is an electronic igniter assembly including an igniter 61 and a sleeve 62. The lighter further comprises a supporting seat 5 mounted on said lighter housing 1 for connecting to windproof jet means, and a bracket 7 dismountably provided on said supporting seat 5 and within said lighter housing 1, wherein said bracket 7 has one side sleeved onto said supporting seat 5 and said windproof jet means 4 of said supporting seat is also partially sleeved into one side of bracket 7, and consequently the port of windproof gas flow 71 on one side of said bracket 7 corresponds to said windproof jet means 4, while another side thereof is provided with an electronic igniter 61 and a sleeve 62, and when said bracket 7 is dismounted, said windproof jet means 4 partially protrudes over said supporting seat 5, so that said windproof jet means 4 may be dismountably mounted with said supporting seat 5.

Figure 2:
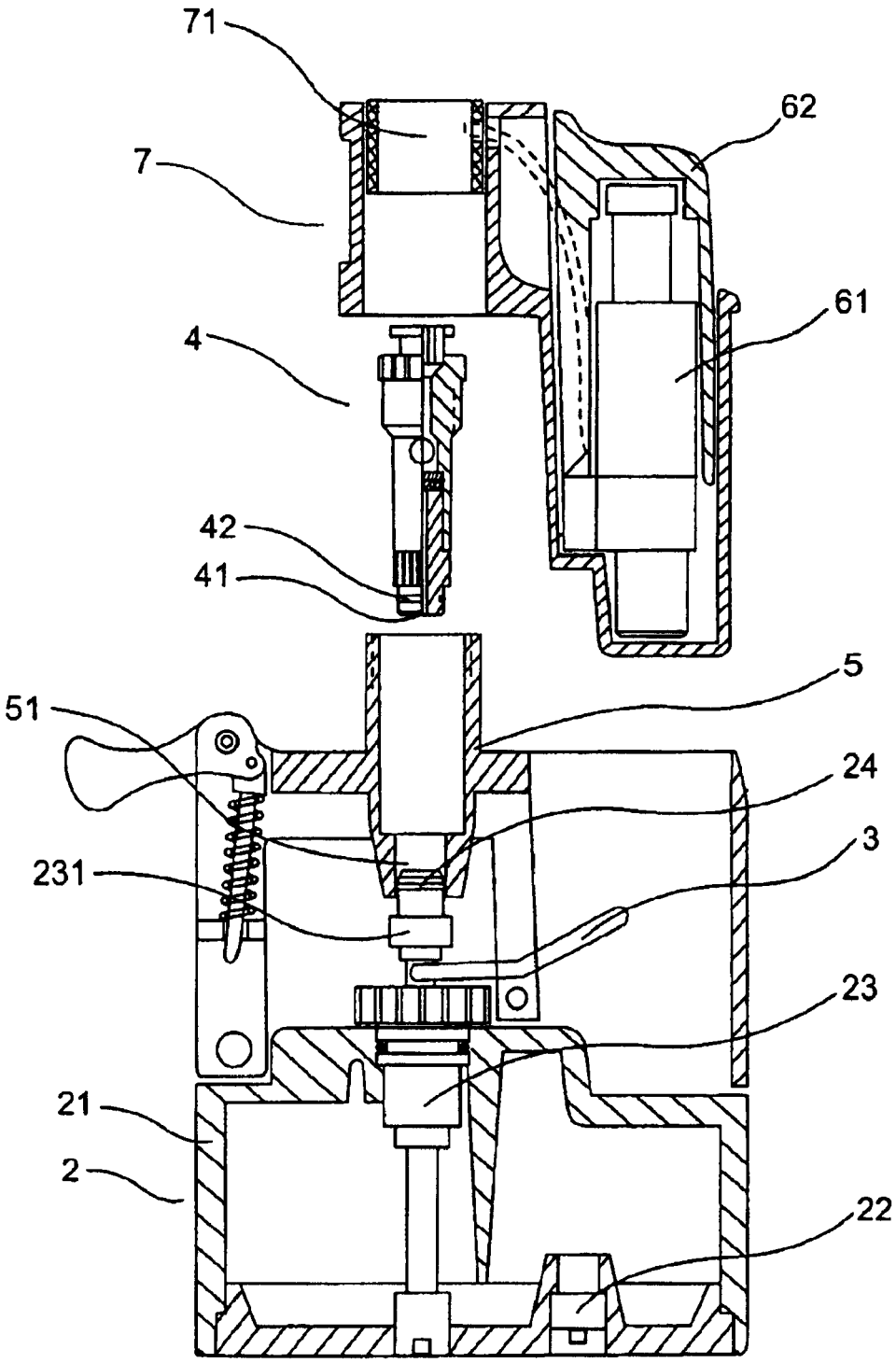
FIG. 2 is a structural sketch of the windproof jet means separated from said igniter assembly.
Figure 3:
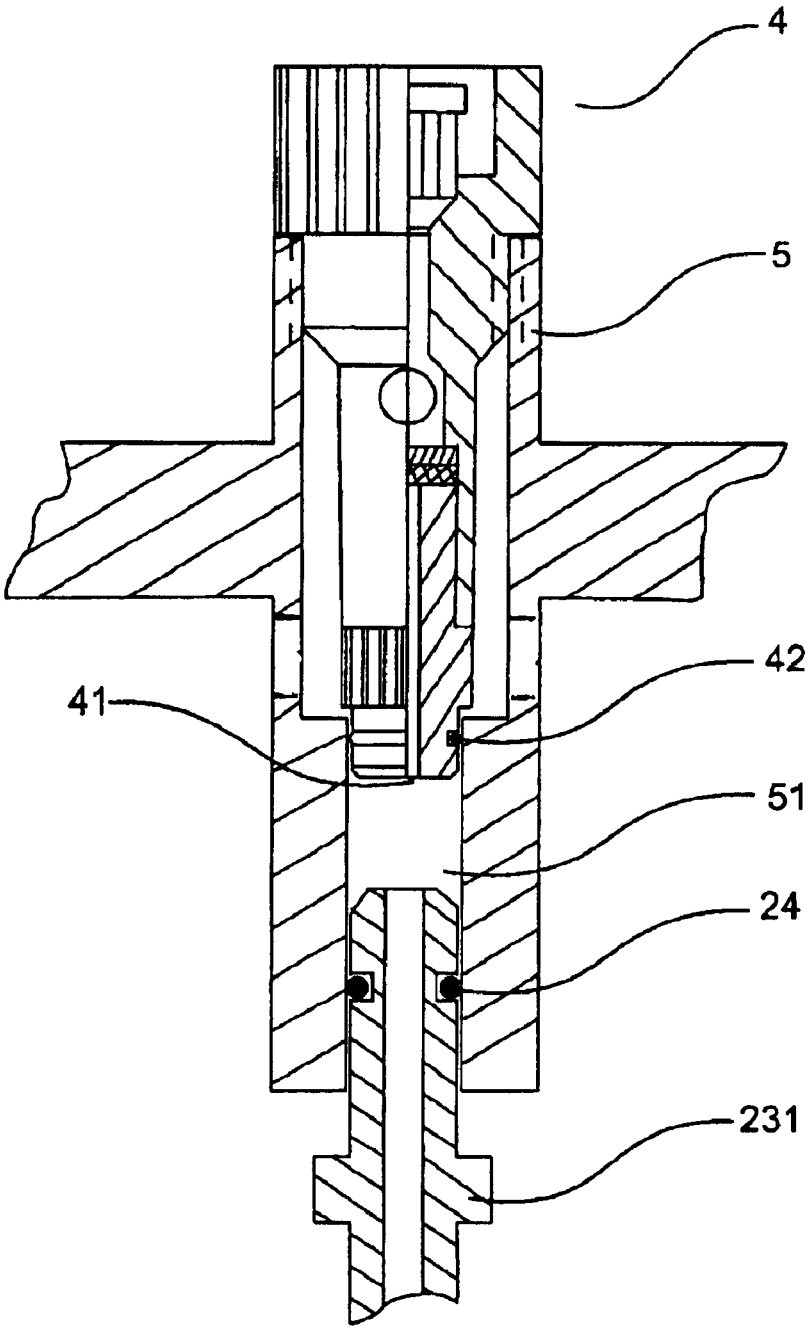
FIG. 3 is a drawing showing sectional structure of the first embodiment of the partial connection between said windproof jet means.

Refer to FIG. 2. when the pore passage of said windproof jet means 4 is blocked or there is need for different shapes of flames which requires for replacement of different windproof jet means 4, said bracket 7 shall be dismounted first, making said windproof jet means 4 partially protrude over said supporting seat 5, so that part of windproof jet means 4 may be turned out with hand fingers and replaced. In addition, as the electronic igniter 61 has a limited times of ignition, the electronic igniter 61, according to the present invention, may be replaced after the bracket 7 is dismounted or said bracket 7 may be replaced which is independent from the core of the lighter.

To prevent the connection of windproof jet means 4 to the passage of storage 2 from being affected by the replacement, said supporting seat 5 has its lower end connected to said outlet valve 23, and windproof jet means 4 is connected to said supporting seat 5 (usually by screw) and has its inlet port 41 located at the lower end of the supporting seat 5 and connected to said outlet port of outlet valve 23, for the purposes of connecting said outlet valve 23 to said windproof jet means 4 by virtue of clamping (or locating) of said supporting seat 5 during the installation after the replacement. Furthermore, a sealing ring of inlet port 42 may be provided between the lower end of said windproof jet means 4 and the lower end of supporting seat 5, thus the fuel gas released from the outlet valve 23 may not be leaked from the conjunction between said windproof jet means 4 and the supporting seat 5 (see FIG. 2). To make the fuel gas from said outlet valve 23 steadily enter said supporting seat 5, a soft pipe 25 may also be provided between the outlet core 231 of said outlet valve 23 and said inlet port 51 of said supporting seat 5 (see FIG. 4). A sealing ring 24 may be provided on the outlet core 231 which extends into the lower end of inlet port 51 at lower end of said supporting seat 5, so that the sealing ring 24 seals the conjunction of outlet core 231 and said supporting seat 5, making the gas from said outlet valve 23 smoothly pass the lower end of said supporting seat 5 and enter said windproof jet means 4 (see FIG. 4).

Figure 4:
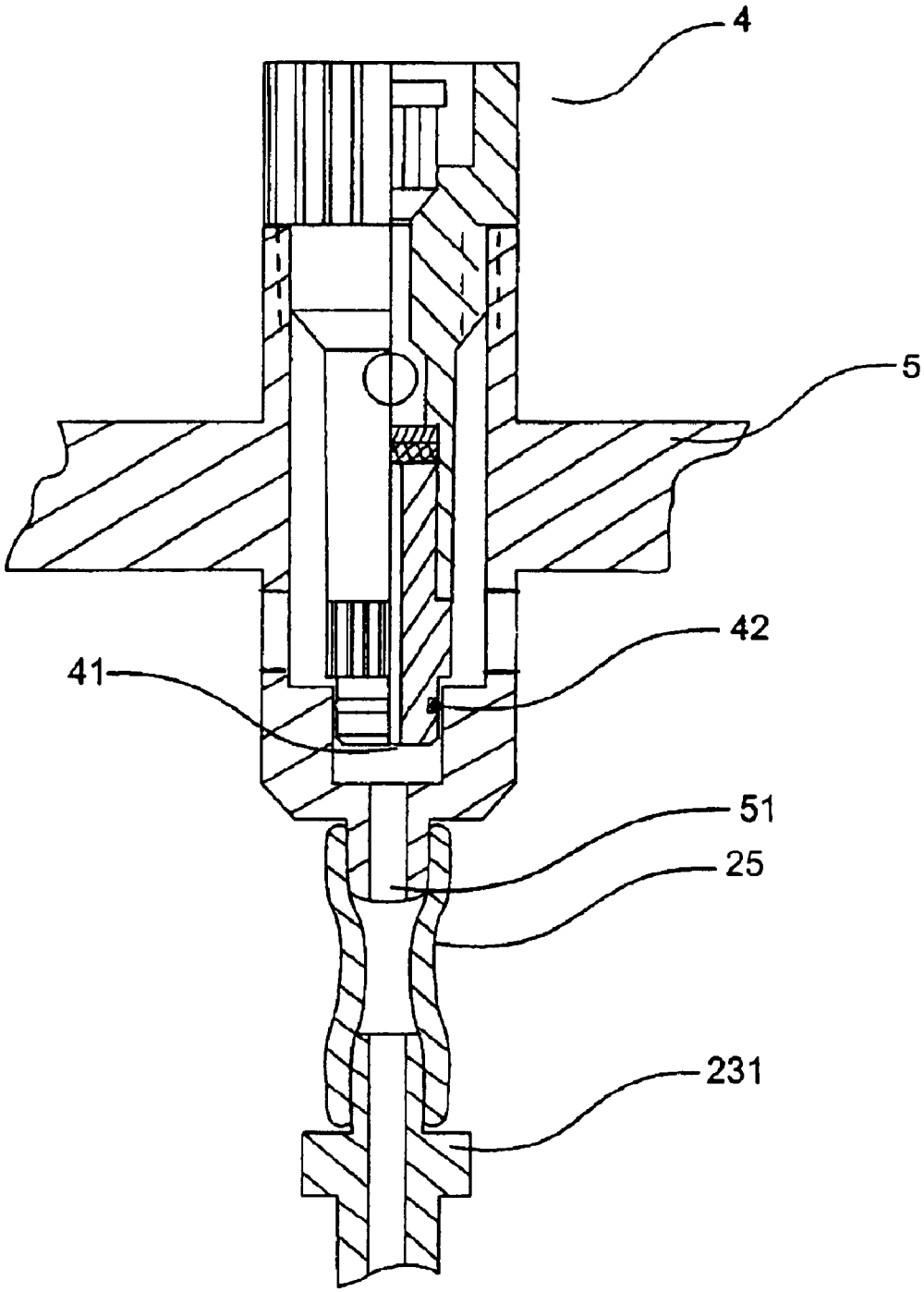
FIG. 4 is a drawing showing sectional structure of the second embodiment of the partial connection between said windproof jet means.
Figure 5:
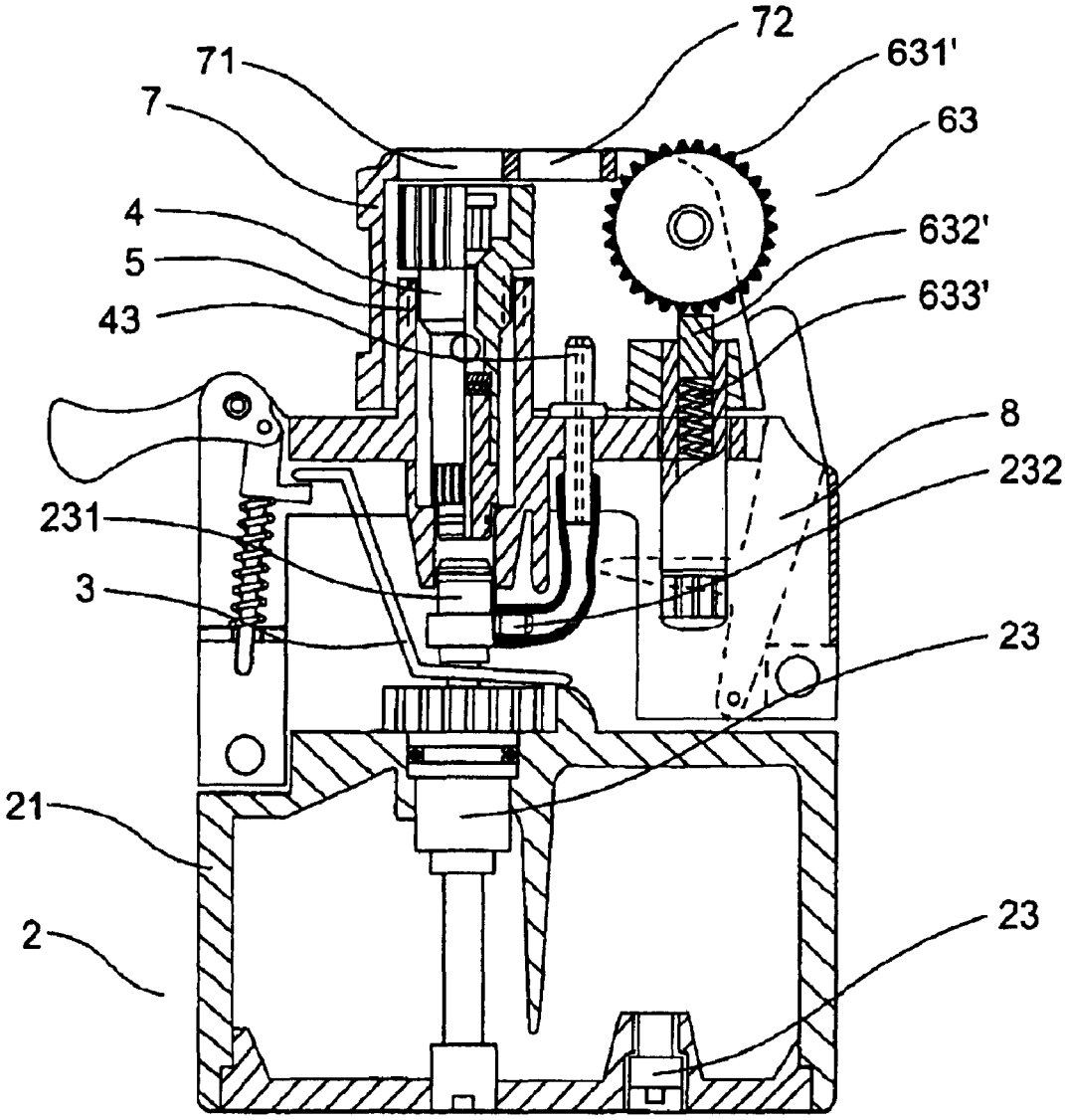
FIG. 5 is a structural sketch of the second embodiment of the present invention.
Figure 6:
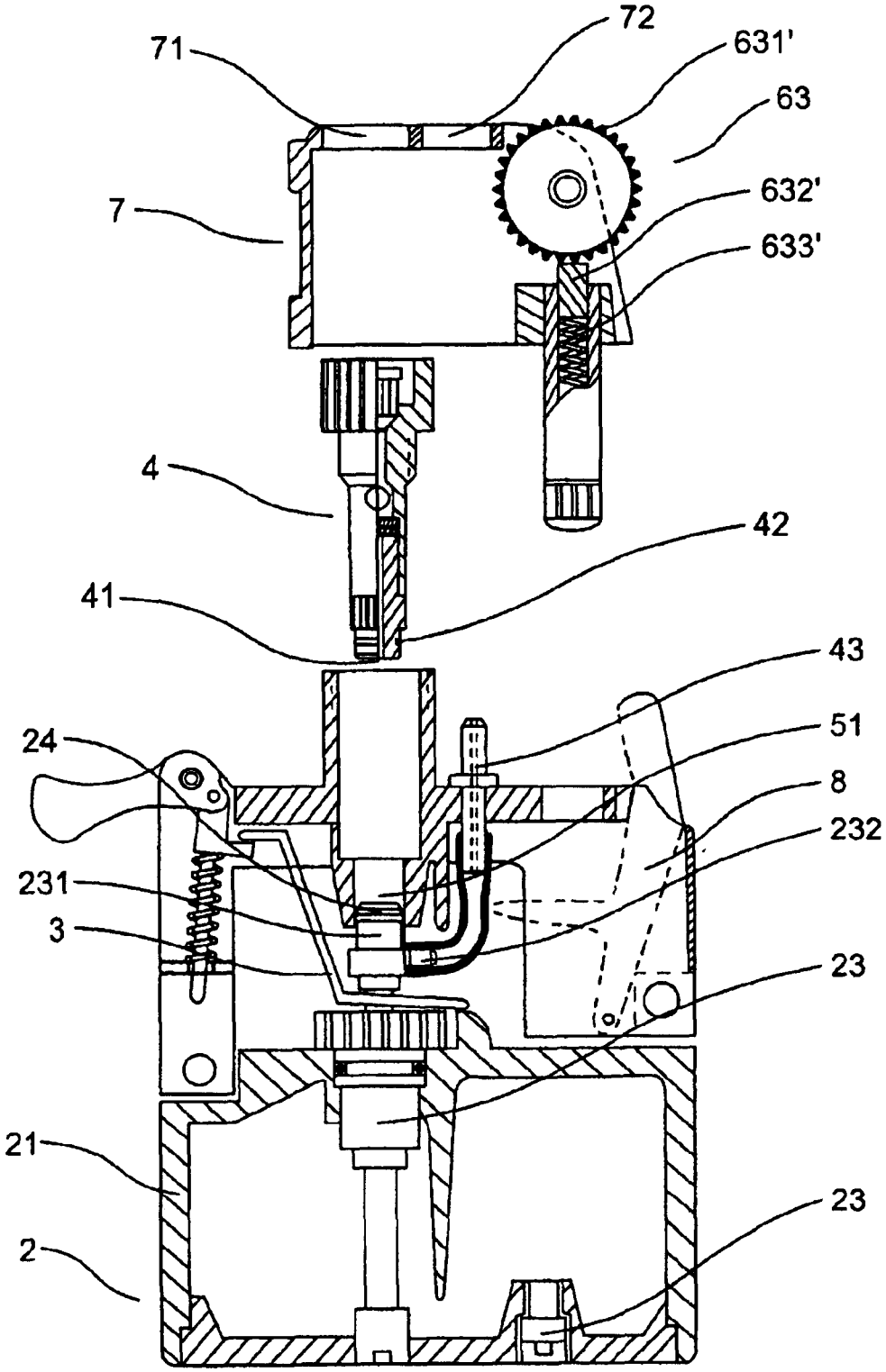
FIG. 6 is an illustration of said windproof jet means and said igniter assembly separated from said lighter housing.

Refer to FIGS. 5 and 6. The technical solutions as shown in the drawings are basically the same to that as shown by FIG. 4. They differ in that said igniter assembly 6 of the present embodiment is a flint ignition device 63, which includes wheel 631', a flint 632' and a spring 633'. On both sides of said outlet valve 23 there is a diverting passage 232 connecting to said candlelight flame outlet pipe 43. There is also a bracket 7 dismountably provided on said windproof jet means 4 above said supporting seat 5 and within said lighter housing 1, and said bracket 7 has side connected to said windproof jet means 4 and the other mounted with an igniter assembly 6, making the windproof torch flame generated by windproof jet means 4 spout out and ignite articles via a port 7 of windproof gas flow, which corresponds to said windproof jet means 4. As for the structure of the flint ignition device 63 for igniting windproof torch flame, a preferred mode of solution is to provide a candlelight flame outlet pipe 43 between said flint ignition device and said windproof jet means 4, and a candlelight gas flow port 72 may be further opened at side of said windproof gas flow port 71, corresponding to the outlet port of said candlelight flame outlet pipe 43. When outlet valve 23 releases fuel gas, said wheel 631' is turned by user's finger and the friction between said wheel 631' and said flint 632 under the pressure of said spring 633' generates sparks which first ignites the fuel gas from the candlelight flame outlet pipe 43 through said candlelight gas flow port 72 in the bracket 7 to produce candlelight flame, and when the finger further presses down to operate the switch 8, the switch 8 in turn presses the soft pipe of said candlelight outlet pipe 43, making the fuel gas flow towards said windproof jet means 4. The candlelight flame out of said pipe 43 at the moment ignites the gas flow from windproof jet means 4, producing a forceful windproof torch flame.

Though the present invention has been described in details by reference to the drawings and embodiments, it should be understood by those skilled in the art that the aforementioned embodiments are only for description of the invention and not in any case limitation to the present invention, and various modifications or variations which fall within the protective scope of the present invention could be made within the scope of the invention.

What is claimed is:

1. A windproof lighter comprising:

a lighter housing, a gas container for storing liquid inflammable gas, a storage with an inlet valve and an outlet valve, an outlet lever for control of gas supply from said storage, a windproof jet means connected to a gas passage of said storage and an igniter assembly, and further comprising a supporting seat on said lighter housing for connecting windproof jet means, a bracket dismountably provided in or above said lighter housing and said supporting seat, wherein said bracket has one side sleeved onto said supporting seat or connected to said windproof jet means while the other side provided with an igniter assembly, and when said bracket is dismounted, said windproof jet means partially protrudes over said supporting seat, so that said windproof jet means may be dismountably mounted with said supporting seat.

2. The windproof lighter as claimed in claim 1, wherein said supporting seat has its lower end connected to said outlet valve and said windproof jet means is connected to said supporting seat and has its inlet port located at the lower end of said supporting seat and connected to the outlet port of said outlet valve.

3. The windproof lighter as claimed in claim 1 or 2, wherein said windproof jet means is connected to said supporting seat by screw.

4. The windproof lighter as claimed in claim 2, further comprising a sealing ring provided between the lower end of said windproof jet means and the lower end of said supporting seat.

5. The windproof lighter as claimed in claims 1, 2 or 4, wherein a soft pipe is connected to the outlet port of said outlet valve and has its other end connected to the inlet port of said supporting seat.

6. The windproof lighter as claimed in claims 1, 2 or 4, wherein a sealing ring is provided on the core of said outlet valve and the core of the valve extends to the inlet port at lower end of said supporting seat and sealed therewith.

7. The windproof lighter as claimed in claim 1 or 2, wherein said igniter assembly comprises an electronic igniter and sleeve.

8. The windproof lighter as claimed in claim 1 or 2, wherein said igniter assembly comprises a wheel, a flint and a spring.

* * * * *